US012133600B2

(12) United States Patent
Loyo

(10) Patent No.: US 12,133,600 B2
(45) Date of Patent: Nov. 5, 2024

(54) CONFIGURABLE BAKERY BOUQUET DISPLAY

(71) Applicant: Heather Karina Loyo, Georgetown, TX (US)

(72) Inventor: Heather Karina Loyo, Georgetown, TX (US)

(73) Assignee: Heather Karina Loyo, Georgetown, TX (US)

( * ) Notice: Subject to any disclaimer, the term of this patent is extended or adjusted under 35 U.S.C. 154(b) by 69 days.

(21) Appl. No.: 17/938,573

(22) Filed: Oct. 6, 2022

(65) Prior Publication Data

US 2023/0109779 A1 Apr. 13, 2023

Related U.S. Application Data

(60) Provisional application No. 63/262,227, filed on Oct. 7, 2021.

(51) Int. Cl.
*A47G 19/30* (2006.01)
*B65D 25/10* (2006.01)
(Continued)

(52) U.S. Cl.
CPC ..... *A47G 19/30* (2013.01); *B65D 25/108* (2013.01); *B65D 25/205* (2013.01); *B65D 65/02* (2013.01); *B65D 85/36* (2013.01)

(58) Field of Classification Search
CPC ..... A47G 19/30; B65D 25/20; B65D 25/205; B65D 65/02; B65D 85/36; B65D 25/108
(Continued)

(56) References Cited

U.S. PATENT DOCUMENTS 1,551,637 A * 9/1925 Bowlen ..... F21V 35/00 248/910
1,638,250 A * 8/1927 Finlayson ..... A47G 7/06 47/41.13

(Continued)

FOREIGN PATENT DOCUMENTS

CA 129713 S 11/2009

OTHER PUBLICATIONS

Anhbakes, Cupcake Bouquet for Valentine's Day, Mother's Day, Birthday or any occasion., (Feb. 4, 2021). Accessed: Sep. 26, 2022, [Online Video]. Available: https://www.youtube.com/watch?v=5GZOKEZUyDo.

(Continued)

*Primary Examiner* — Bryon P Gehman

(74) *Attorney, Agent, or Firm* — Thompson Patent Law Offices PC

(57) ABSTRACT

Apparatus and associated methods relate to packing and presenting confectionaries. In an illustrative example, a cupcake bouquet frame may be assembled by (releasably) coupling an upper cover and a lower base. The cupcake bouquet frame, for example, may include spatially distributed cupcake holders on a continuous surface of the upper cover. The cupcake holders may be formed by following cutlines disposed on the upper cover. In a stowage mode, the cupcake holders may be substantially continuous with the continuous surface. In a display mode, when a cupcake is inserted into a cupcake holder, a portion of the continuous surface is displaced to support a bottom of the cupcake while remaining in physical connection to the continuous surface.

(Continued)

Various embodiments may advantageously provide an easy to assemble, aesthetically pleasing, and/or cost-effective frame for creating a cupcake bouquet that resembles a flower bouquet.

23 Claims, 5 Drawing Sheets

(51) Int. Cl.
*B65D 25/20* (2006.01)
*B65D 65/02* (2006.01)
*B65D 85/36* (2006.01)

(58) Field of Classification Search
USPC ..... 206/457; 428/17–27
See application file for complete search history.

(56) References Cited

U.S. PATENT DOCUMENTS

| | | | | |
|---|---|---|---|---|
| 4,844,243 | A * | 7/1989 | Stiles | A47F 3/14 426/119 |
| D422,456 | S | 4/2000 | Krueger | |
| D578,338 | S | 10/2008 | Vendl et al. | |
| D600,505 | S | 9/2009 | Godinger | |
| D601,379 | S | 10/2009 | Leo | |
| D604,109 | S | 11/2009 | Madagan | |
| D630,904 | S | 1/2011 | Zeilinger | |
| 8,167,128 | B2 | 5/2012 | McGinnis et al. | |
| D698,610 | S | 2/2014 | Tavoularis | |
| 8,708,166 | B1 * | 4/2014 | Crouch | A47G 19/00 211/85.4 |
| 8,720,689 | B2 | 5/2014 | Kirkland et al. | |
| 10,189,634 | B2 * | 1/2019 | Elgamal | B65D 5/68 |
| 2007/0023607 | A1 | 2/2007 | Franczyk | |
| 2007/0039849 | A1 * | 2/2007 | Rodriguez | B65D 5/4262 206/457 |
| 2011/0048997 | A1 | 3/2011 | Vandervliet | |
| 2012/0118841 | A1 | 5/2012 | West et al. | |
| 2013/0337126 | A1 * | 12/2013 | Mys | A47G 19/00 211/85.4 |
| 2016/0157671 | A1 | 6/2016 | Fishel et al. | |
| 2017/0158375 | A1 | 6/2017 | Isaac | |
| 2017/0303707 | A1 | 10/2017 | McSorley | |
| 2018/0020682 | A1 | 1/2018 | Bullard | |

OTHER PUBLICATIONS

Cody, R., How to make a cupcake bouquet, (Jun. 16, 2019). Accessed: Sep. 26, 2022, [Online Video], Available: https://www.youtube.com/watch?v=rRm-neTx_nY.

Decopac, How to Assemble the Cupcake Bouquet Cake Box, (Feb. 19, 2021), Accessed: Sep. 26, 2022. [Online Video], Available: https://www.youtube.com/watch?v=3SZKGf0xf68.

Delish, "Edible Bouquets for Mother's Day," Delish, May 6, 2011, (accessed Sep. 26, 2022), https://www.delish.com/food/news/a37441/edible-bouquets-for-mothers-day/.

Ebay, Wooden Basket With Handle—Heart Shape—Collapsible—One Piece—Herb Mathes, ebay.com, retrieved from the internet Sep. 22, 2022, https://www.ebay.com/itm/254187640343.

Hoang, A., Hydrangea Cupcake Bouquet, Feb. 12, 2012). Accessed: Sep. 26, 2022. [Online Video]. Available: https://www.youtube.com/watch?v=yu3bkHfdaxQ.

Restaurantware, 6 oz Terracotta Plastic Mini Flower Pot Cup—with Lid—3"×3"×3"—100 count box—Restaurantware, Amazon.com, retrieved from the internet, https://www.amazon.com/Restaurantware-RWP0443BR-Terracotta-Plastic-Flower/dp/B07GW9KMY4?th=1.

Westaurantstore, Choice 32 oz. Clear Plastic Dome Lid with Hole—500/Case, retrieved from the internet Sep. 22, 2022, https://www.webstaurantstore.com/choice-32-oz-clear-plastic-dome-lid-with-hole-case/500LDOME32.html.

Yiwu Parmay Arts & Craft Co., Ltd, Mybbshower Silver Glitter Scalloped Cupcake Wrappers for Wedding Birthday New Year Eve Party Cake Decoration Pack of 48, Amazon.com, Mybbshower Store, retrieved from the Internet, https://www.amazon.com/Mybbshower-Scalloped-Wrappers-Birthday-Decoration/dp/B09BMTJ1HH/ref?th=1.

* cited by examiner

CONFIGURABLE BAKERY BOUQUET DISPLAY

CROSS-REFERENCE TO RELATED APPLICATIONS

This application claims the benefit of U.S. Provisional Application Ser. No. 63/262,227, titled "Configurable Bakery Bouquet Display," filed by Heather Karina Loyo, on Oct. 7, 2021.

This application incorporates the entire contents of the foregoing application(s) herein by reference.

FIELD

Various embodiments relate generally to food packaging.

BACKGROUND

Confectionery is the art of making confections. In general, confectionery may be divided into two broad categories, baker confections and sugar confections. Baker confectionery, sometimes also called flour confections, includes principally sweet pastries, cakes, and similar baked goods. Sugar confectionery includes candies, candied nuts, chocolates, chewing gum, bubble gum, and other confections that are made primarily of sugar. In the modern days, sugar-free versions of sugar confections also exist to address health concerned consumers.

One kind of confectionery is a cupcake. A cupcake is a small cake designed to serve one person, which may be baked, for example, in a small (thin) paper, silicone, or aluminum cup. As with larger cakes, frosting and other cake decorations such as fruit and candy may be applied. In the early 19th century, there were two different uses for the term cup cake or cupcake. Before muffin tins were widely available, cakes were often baked in individual pottery cups, ramekins, or molds. Thus, these cakes are sometimes called as cupcakes as they were baked in the cups. Nowadays, a cupcake generally refers to a small and, sometimes, round cake that may be about the size of a teacup.

A bouquet may be a decorative arrangement of items. A flower bouquet is a collection of flowers in a creative arrangement and may be arranged for decoration and/or may be handheld. A cupcake bouquet may be a decorative arrangement of cupcakes. A cupcake bouquet may be creatively arranged in different arrangements. Cupcake bouquets may, for example, be given for special occasions such as birthdays, anniversaries, baby shower, bridal shower, and/or graduation. A cupcake bouquet may sometimes be a sweet and edible alternative to a traditional floral arrangement. In some cases, a cupcake bouquet may serve in a party as both a centerpiece and dessert for guests.

SUMMARY

Apparatus and associated methods relate to packing and presenting confectionaries. In an illustrative example, a cupcake bouquet frame may be assembled by (releasably) coupling an upper cover and a lower base. The cupcake bouquet frame, for example, may include spatially distributed cupcake holders on a continuous surface of the upper cover. The cupcake holders may be formed by following cutlines disposed on the upper cover. In a stowage mode, the cupcake holders may be substantially continuous with the continuous surface. In a display mode, when a cupcake is inserted into a cupcake holder, a portion of the continuous surface is displaced to support a bottom of the cupcake while remaining in physical connection to the continuous surface. Various embodiments may advantageously provide an easy to assemble, aesthetically pleasing, and/or cost-effective frame for creating a cupcake bouquet that resembles a flower bouquet.

Various embodiments may achieve one or more advantages. For example, some embodiments may advantageously be easily concealed by the cupcakes and/or decorative tissues. Some embodiments may, for example, advantageously prevent melted icing from dropping. For example, some embodiments may include a stalk to advantageously display a message above the inserted cupcakes. Various embodiments may advantageously provide selectively assembled support elements providing extra dimension(s) of placement for the cupcakes. Some embodiments may advantageously prevent cupcakes from falling through the cupcake reception openings. Some embodiments may advantageously stabilize a cupcake bouquet frame. Such embodiments may advantageously prevent the cupcake bouquet from tipping. Some embodiments may advantageously retain ribbon and/or other decorative materials on the cupcake bouquet. Some embodiments may advantageously enhance user experience in picking up a cupcake.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, a cupcake bouquet using an exemplary cupcake bouquet frame is introduced with reference to FIGS. 1-3. Second, that introduction leads into a description with reference to FIGS. 4-5 of some exemplary embodiments of an exemplary cupcake bouquet frame. Third, the discussion turns to exemplary embodiments that illustrate various embodiments and features of exemplary cupcake bouquet frames. Finally, the document discusses further embodiments, exemplary applications and aspects relating to making a cupcake bouquet frame.

Figure 1:
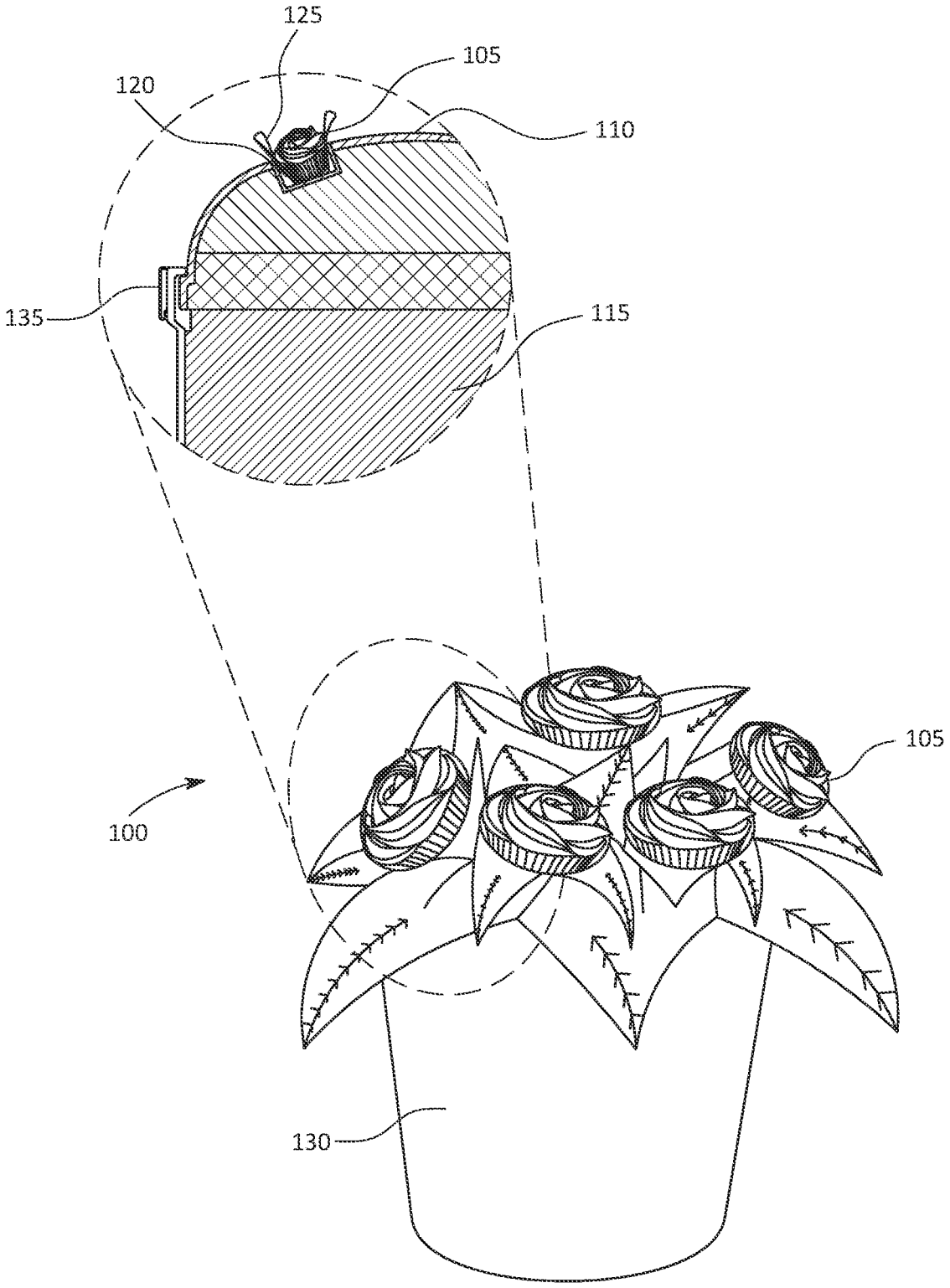
FIG. 1 depicts an exemplary cupcake bouquets frame employed in an illustrative use-case scenario.

FIG. 1 depicts an exemplary cupcake bouquet frame 100 employed in an illustrative use-case scenario. In this example, the cupcake bouquet frame 100 is holding a plurality of cupcakes 105. As shown in the break-out figure, the cupcake 105 is held by an upper cover 110 of the cupcake bouquet frame 100.

In some implementations, the upper cover 110 may be a dome shaped cover coupled, in this example, to a base 115 of the cupcake bouquet frame 100. For example, the upper cover 110 may be releasably coupled to (e.g., snapped into) the base 115. In some implementations, the upper cover 110 may be made with plastic. In this example, the upper cover 110 includes a cupcake reception opening 120 for holding the cupcake 105 in place. In some implementations, the cupcake reception opening 120 may include a cut-out area of the upper cover 110, creating a hole for insertion of the cupcake 105. In some implementations, the cupcake reception opening 120 may be formed by specially cutting the upper cover 110 such that, in use, the cupcake reception opening 120 may form a basket to hold the cupcake 105. In some examples, the upper cover 110 may include a predetermined number of the cupcake reception openings 120 for holding the cupcake 105.

In the depicted example, the cupcake 105 is inserted into the cupcake reception opening 120 with a decoration material 125. For example, the decoration material 125 may include a colored tissue paper for decorating the cupcake bouquet. In some examples, the decoration material 125 may be a plastic sheet. In some examples, the decoration material 125 may be a colored foil. For example, the decorative materials 125 may wrap around a bottom portion of each cupcake before insertion into the cupcake reception opening 120. In some embodiments the decorative material 125 may be disposed over the cupcake reception opening 120 and the cupcake 105 may, when inserted, capture the decorative material 125 between the cupcake 105 and the upper cover 110.

As shown, the extended portion of the decorative materials 125 from the cupcake reception opening 120 may be arranged to lay on top of the cupcake bouquet frame 100. In some implementations, the cupcake bouquet frame 100 may advantageously be hidden under the cupcakes 105 and the decorative materials 125.

In various embodiments, a user may remove the cupcake 105 by pulling the decorative material 125 on opposite corners. In some examples, the decorative material 125 may allow the user to remove the cupcake 105 from the cupcake bouquet frame. For example, the decorative material 125 may allow the user to remove the cupcake 105 while allowing the user to remain substantially clear from frosting of the cupcake 105 and/or adjoining cupcakes.

The lower base 115, in this example, is covered by a decorative base 130. In this example, the decorative base 130 is depicted as a pot (e.g., a flower pot). In various embodiments, the decorative base 130 may include different sizes and shapes. For example, the decorative base 130 may be a coffee cup. In another example, the decorative base 130 may be a vase. Various exemplary implementations are depicted with reference to page 11 of Appendix A.

In some embodiments, a lower base 115 may be configured as a decorative base. For example, the lower base 115 may be configured to receive a decorative element (e.g., tissue paper, wrapping paper). In some embodiments the lower base 115 may, for example, be decorative. For example, decorative features (e.g., printing, appliques) may be applied to the lower base 115. Such embodiments may advantageously provide a completely disposable cupcake bouquet container. In some embodiments the upper cover 110 may be decorative. Such embodiments may, for example, advantageously allow a user to omit the decorative materials 205, 210.

In various embodiments, in use, the upper cover 110 and the lower base 115 may be snapped together to create the cupcake bouquet frame 100 to hold a predetermined number of cupcakes 105. In some implementations, the upper cover 110 and the lower base 115 may advantageously be manufactured as stackable components. In some embodiments, for example, the upper cover 110 may be configured to nest (e.g., upside down) within the lower base 115.

In some embodiments the upper cover 110 may be stacked and provided as one component. The lower base 115 may, for example, be stacked and provided as a separate component. In some embodiments the upper cover 110 may, for example, be independent of the lower base 115. The upper cover 110 may, for example, snap inside the lower base 115. Such embodiments may, by way of example and not limitation, urge decorative material upwards to cover the lower base 115 upon assembly of the upper cover 110 to the lower base 115. In various such embodiments, for example, a cupcake bouquet maker may assemble a desired upper cover 110 (e.g., having a desired cupcake hole configuration, desired shape) with a desired lower base 115 (e.g., desired shape, desired depth, desired decorative element(s)). Various such embodiments may, for example, reduce storage space and shipment costs.

In some embodiments the upper cover 110 may be coupled (e.g., by a living hinge) to the lower base 115. For example, the upper cover 110 and the lower base 115 may be coupled in a 'clamshell' configuration. For example, the coupled upper cover 110 and the lower base 115 may be manufactured as a single unit (e.g., assembled by a hinge, formed of continuous material). Such embodiments may, for example, be shipped in an open configuration (e.g., the upper cover 110 swung back and upside down) such that each respective upper cover 110 and lower base 115 stacks compactly with like assemblies.

In various implementations, the upper cover 110 may define a continuous surface with the (spatially-distributed) cupcake reception openings 120. For example, the cupcake reception opening 120 may be configured to support the cupcake 105 disposed into it. In this example, the lower base 115 includes a predetermined coupling region 135. For example, the predetermined coupling region 135 may include a mating feature configured to engage a matching feature at the upper cover 110. For example, the upper cover 110 may be releasably coupled into the lower base at the predetermined coupling region 135.

In some implementations, the cupcake reception opening 120 may be spatially distributed to create an illusion of a flower bouquet. For example, a distance between adjacent cupcake reception openings 120 may be less than a predetermined separation distance (PSD). For example, the PSD may be less than 0.25 inch. For example, the PSD may be less than 0.5 inch.

Figure 2:
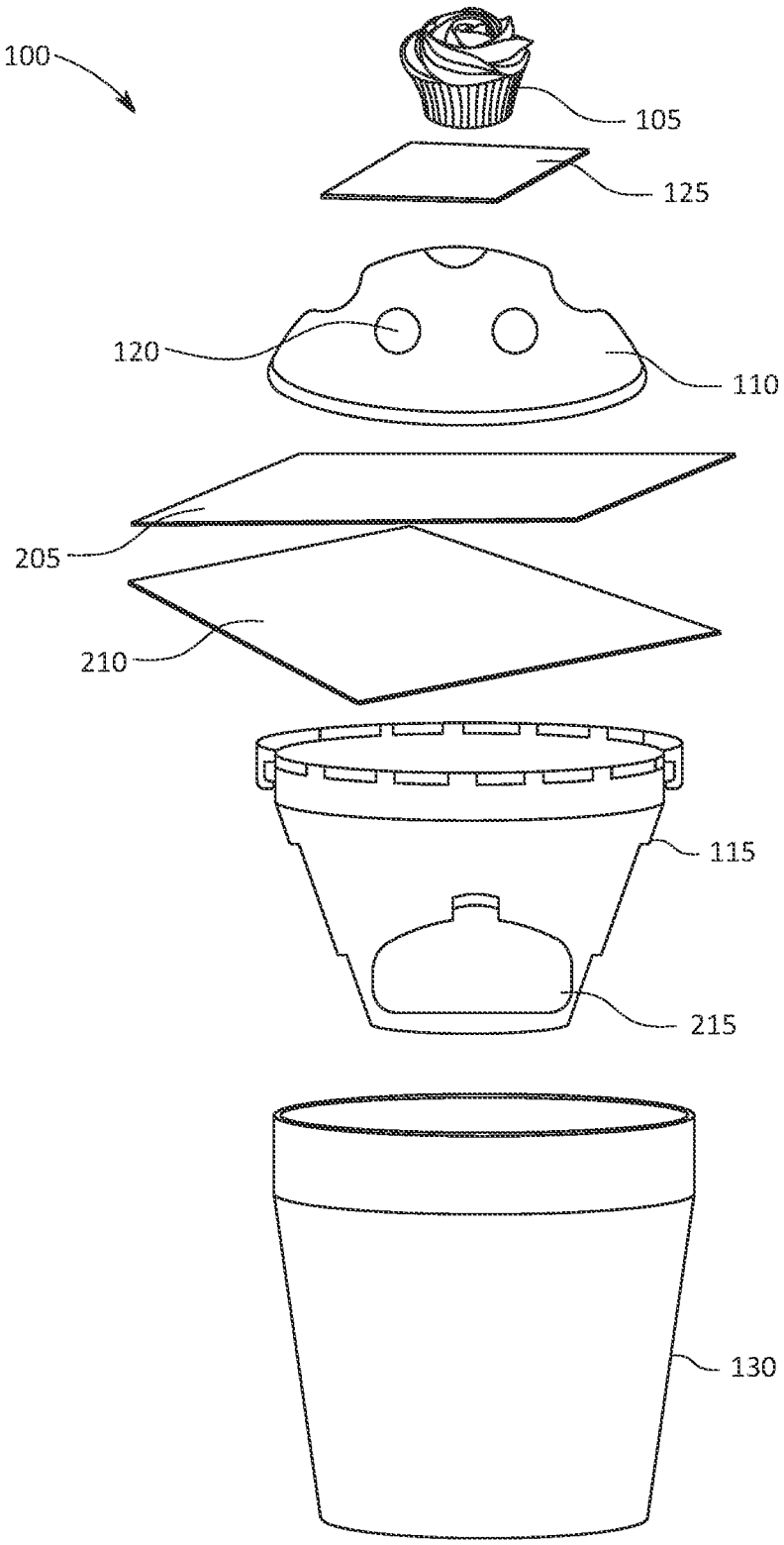
FIG. 2 shows an exploded assembly of an exemplary assembly of a cupcake bouquets frame.

FIG. 2 shows an exploded view of an exemplary assembly of a cupcake bouquets frame 100. The cupcake 105 is, in this example, surrounded by the decorative material 125. In the depicted example, the decorative material 125 is a diamond-shaped sheet. In various embodiments, a diamond-shaped sheet (e.g., provided with at least two corners that are slightly longer) may advantageously allow the assembled cupcake 105 to be picked up easily by tugging on these two corners that sit slightly longer as they stick up slightly higher than the cupcake 105. In various embodiments, a diamond-shape decorative material 125 may advantageously induce, when the material is assembled in the frame, corners of the decorative material 125 to have a difference in height that is visually more appealing and helps create the illusion of leaves around the flowers. In other implementations, the decorative material 125 may be a triangular sheet. In some embodiments, the decorative material 125 may be a square sheet. In some embodiments the decorative material 125 may be a desired polygonal and/or curvilinear shape. In other implementations, the decorative material 125 may be in various other decorative shapes.

In some implementations, the cupcake 105 may be inserted into the cupcake reception opening 120 of the upper cover 110. The cupcake bouquet frame 100 includes a plurality of circular cupcake reception openings 120 in this example. In some implementations, the upper cover 110 may include different number of openings such as, by way of example and not limitation, 7, 12, 19, 21 or 30 cupcake reception openings 120. Depending on an aesthetic requirement and/or size(s) of the cupcake bouquet frame 100 and/or the cupcake 105, the upper cover 110 may include other numbers of cupcake reception openings 120.

In the depicted example, the upper cover 110 may couple with the lower base 115. The upper cover 110 may capture, during assembly, decorative materials 205, 210 (as depicted). For example, the upper cover 110 may snap into the lower base 115 with the decorative materials 205, 210 in between. In various embodiments, the decorative materials 205, 210 may include, by way of example and not limitation, plastic, silicone, colored metal foil, tissue paper, and/or other decorative materials. For example, the decorative materials 205, 210 may cover the coupling portion of the upper cover 110 and the lower base 115 and substantially hide the cupcake bouquet frame 100 from view. In some implementations, the (dome shaped) upper cover 110 and the lower base 115. Accordingly, for example, when the upper cover 110 is releasably coupled into the lower base 115, the decorative materials 205, 210 may extend beyond the upper cover 110. For example, the decorative materials 205, 210 may advantageously be urged upwards to appear like a bouquet.

The lower base 115 includes, in this example, a weight 215. For example, the weight 215 may be a container filled with water. In some examples, the weight 215 may be a bag filled with pebbles. In other examples, the weight 215 may be a container filled with other confectionaries like chocolate. In various embodiments, the weight 215 counterweights the weight at the top of the cupcake bouquet frame 100. In some examples, the weight 215 may advantageously maintain a weight balance of the cupcake bouquet frame 100. For example, the weight 215 may prevent the cupcake bouquet from easily (accidentally) tipping over. In some implementations, the weight 215 may be divisible by a divider device (e.g., a device with multiple internal compartments) to distribute weights evenly across the lower base 115.

As shown, the cupcake bouquet frame 100 is inserted into the decorative base 130. For example, the decorative base 130 may be a commercially available receptacle such as a vase, flowerpot, coffee mug, etc. In various implementations, the cupcake bouquet frame 100 may be held in place by its weight at the decorative base 130. In some implementations, the cupcake bouquet frame 100 may be adhered to the decorative base 130 using adhesive. For example, by using a coupling element (e.g., double-sided tape, hot glue), the cupcake bouquet frame 100 may be affixed to the decorative base 130.

Figure 3:
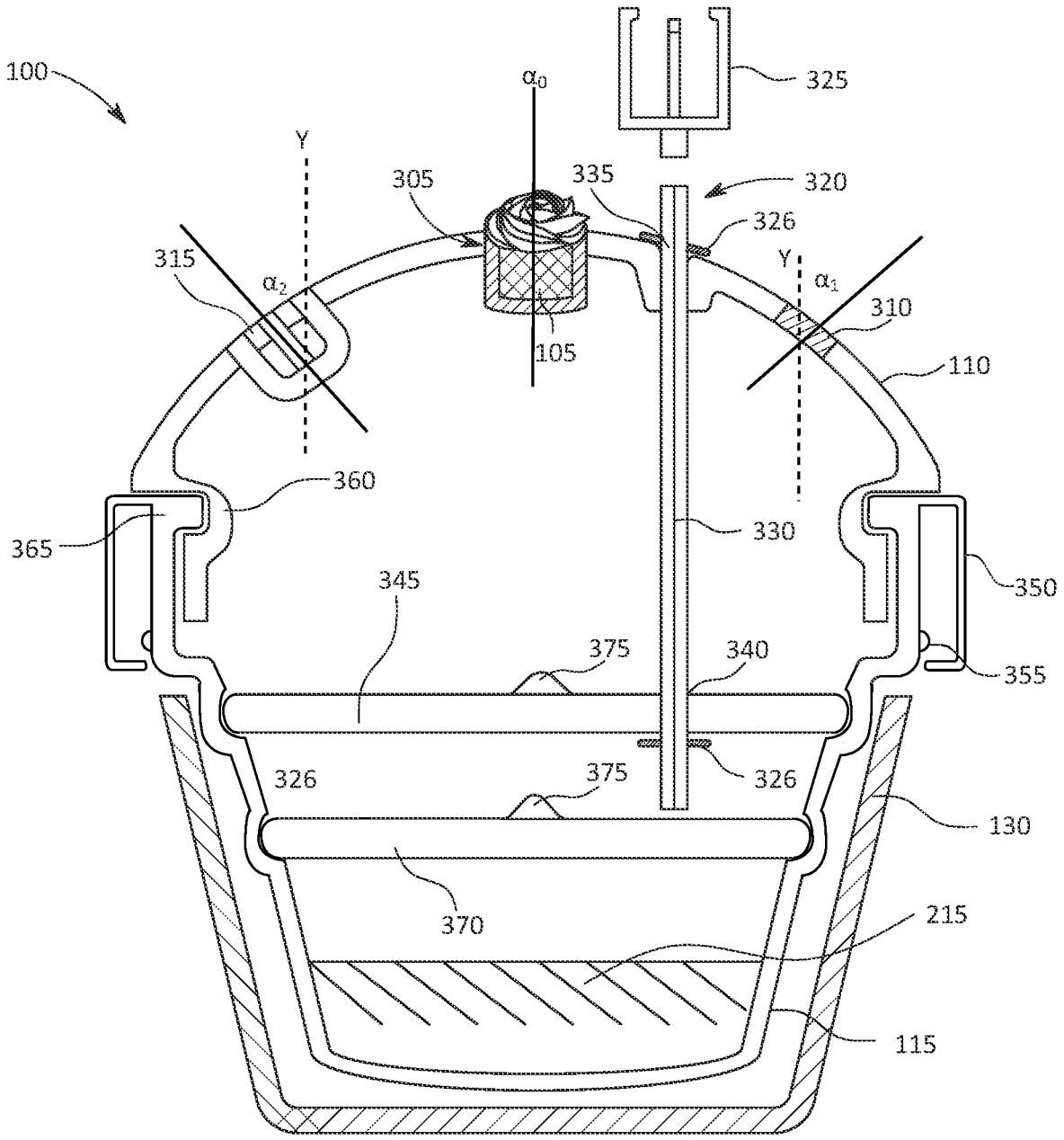
FIG. 3 shows a cross-section view of an exemplary cupcake bouquet frame.

FIG. 3 shows a cross-section view of an exemplary cupcake bouquet frame 100. In this example, the cupcake bouquet frame 100 includes a plurality of a cupcake reception opening 305 and cupcake reception baskets 310 and 315. For example, the cupcake reception opening 305 may be a cut-through hole for holding the cupcake 105 in place. In this example, the cupcake reception basket 310 is shown in a stowage mode, and the cupcake reception basket 315 is shown in a deployed mode. For example, the cupcake reception basket 310 may be substantially continuous with a continuous surface of the upper cover 110. For example, the cupcake reception basket 315 may hold a confection (e.g., the cupcake 105).

In various embodiments, the cupcake reception basket 310 may include cut-lines for deployment transition. For example, these cut-lines may allow the cupcake reception basket 310 in the stowage mode to transition into the deployed mode. For example, when a cupcake is inserted into the cupcake reception basket 310, the material of the upper cover may follow the cut-lines and spin in a first rotational direction (e.g., clockwise) and drop down to create a basket. In some examples, the cupcake reception basket 315 may hold the cupcake in place and prevent the cupcake being placed and/or sliding too far through the opening. As shown, a portion of the continuous surface of the upper cover 110 may be displaced to support a bottom of the cupcake 105 while remaining in physical connection to the continuous surface.

As shown, the cupcake reception baskets 310, 315 may hold the cupcake 105 in various angles $\alpha_1$ and $\alpha_2$ with respect to a vertical axis Y. For example, the angles $\alpha_1$ and $\alpha_2$ may be defined as angles between a vertical axis Y and vertical axes of the cupcake reception baskets 310, 315, respectively. In various embodiments, the angles $\alpha 1$ and $\alpha 2$ may be configured to be less than a predetermined angle $\alpha_{max}$. For example, $\alpha_{max}$ may be less than 60°. For example, $\alpha_{max}$ may be less than 45°. For example, $\alpha_{max}$ may be less than 80°. By configuring the $\alpha_{max}$, the cupcake bouquet frame 100 may advantageously prevent melted icing (due to excessive heat) from falling. In some implementations, the upper cover 110 may be configured to include at least half of the cupcake reception baskets to be parallel to ground (e.g., the cupcake reception opening 305) such that $\alpha_0$=0°.

In this example, the cupcake bouquet frame 100 further includes a cupcake holder stick 320. The cupcake holder stick 320 may, for example, be configured to hold a cupcake in an elevated position. The cupcake holder stick 320 includes prongs 325 for holding a cupcake in position and a stalk 330. In some implementations (as depicted), the prongs 325 may include small nubs on the end to create a tight fit around the cupcake 105. In some implementations, a body of the prongs 325 may be at least partially elastic. Such implementations may, for example, enable placement of the cupcake 105 by a user. For example, a user may use the cupcake holder stick 320 to hold a cupcake at an elevation different from other cupcake reception openings of the cupcake bouquet frame 100.

In the depicted example, the cupcake holder stick 320 is inserted into the cupcake bouquet frame 100 through a slit 335 of the upper cover 110 and a lower slit 340 at a middle cover 345. For example, the middle cover 345 may be coupled to a tab grip element in an interior cavity of the lower base 115. In various embodiments, the slit 335, 340 may be cross-shaped to advantageously keep the cupcake holder stick 320 stable in position. For example, the cross-shaped design may hold the cupcake holder stick 320 firmly and prevent rotation of the cupcake holder stick 320. In some embodiments, the slit 335, 340 may, by way of example and not limitation, be configured as an aperture (e.g., hole, slit). The aperture may, for example, be configured to matingly engage with a perimeter of a cross-section of a stick (e.g., 320). The aperture may, for example, be cross-shaped. The aperture may, for example, be polygonal (e.g., square, star, hexagonal). The aperture may, for example, be curvilinear (e.g., oval, circular). In some implementations, for example, the aperture may be configured to matingly engage to resist rotation (e.g., mating non-circular shapes).

In some implementations, the cupcake holder stick 320 may insert into the upper cover 110 without penetrating the middle cover 345. In some examples, the middle cover 345 may provide a second point of anchor to the cupcake holder stick 320. For example, the lower slit 340 of the middle cover 345 may stabilize the cupcake holder stick 320 when coupled with the stalk 330. In some embodiments, providing a second point of anchor (e.g., through the upper cover 110 and through the middle cover 345) may advantageously enable stable display of a cupcake in an elevated position. Multiple (e.g., two or more) vertical anchor points may advantageously prevent tipping of the elevated cupcake. In various embodiments, the slit may be an "X", as depicted. In some embodiments the slit may be a triangular shape. In some embodiments the slit may include a "*" shape. In some embodiments the slit may be a hole (e.g., circular, polygonal, curvilinear).

As depicted, the cupcake holder stick 320 is further provided with one or more retaining disks 326. In some embodiments the retaining disk 326 may, for example, be a separate component. The retaining disk 326 may be assembled to the stalk 330 after passing the stalk 330 through the upper cover 110 and through the lower slit 340 of the middle cover 345 in order to provide stabilization. In some embodiments, the retaining disk 326 may be assembled to the stalk 330 before passing through the upper cover 110 in order to keep the weight of the cupcake from pushing the stick down into the container over time (e.g., to maintain an originally assembled height). In some embodiments the retaining disk 326 may, for example, be unitarily formed (e.g., assembled during manufacturing, fixedly coupled, formed from continuous material) with the stalk 330. The retaining disk 326 may, for example, be semi-rigid. The retaining disk 326 may, for example, be configured to at least partially deform as it is inserted through an aperture (e.g., the lower slit 340). The retaining disk 326 may, for example, flatten if the stalk 330 is attempted to be withdrawn back through an aperture (e.g., through the middle cover 345).

In this example, the lower base 115 includes a ribbon tab 350 and a ribbon holder 355. For example, the ribbon tab 350 may be a small piece of plastic parallel to the edge of an outer surface of the lower base 115. In some embodiments, the ribbon tab 350 may form an L-shape pointing towards the ribbon holder 355. In some implementations, the ribbon tab 350 and the ribbon holder 355 may advantageously hold and keep one or more ribbons. In some examples, the cupcake bouquet frame 100 may include four ribbon tabs 350 at a top edge of the lower base 115. For example, a user may tie a ribbon through the ribbon tab 350 to decorate the cupcake bouquet. In some examples, the ribbon may be prevented from falling by the friction of the ribbon holder 355 and the support from the ribbon tab 350.

As shown, the lower base 115 includes an upper lip 360 in register with a receiving edge 365 of the upper cover 110, such as disclosed at least with reference to FIG. 2. In some examples, the upper lip 360 and the receiving edge 365 may be snapped substantially tightly together. In various embodiments, thin and flexible decorative materials may be snapped between the upper cover 110 and the lower base 115. For example, the tightly snapped upper cover 110 and the lower base 115 may cause the decorative material to ruffle around the cupcake bouquet. For example, the ruffle may advantageously provide a pleasing illusion of flower bouquet wrapped in greenery or tissue paper for gifting.

In this example, the weight 215 at the bottom of the cupcake bouquet frame 100 is configured as a compartment of the cupcake bouquet frame 100 separated by an inner lid 370. For example, the inner lid 370 and the compartment may enclose the weight 215. For example, the inner lid 370 may prevent the weight 215 at the bottom of the lower base 115 from spilling out. In some implementations, the inner lid may include a plug for input and draining of the weight 215 in liquid form. In some implementations, the weight 215 may be a separate container. For example, the weight 215 may include water deposited into the bottom of the base. In some embodiments the container may be a round bag filled with water and inserted into the bottom of the lower base 115.

As depicted, the middle cover 345 and the inner lid 370 each are releasably coupled to the lower base 115 by engaging respective features of the wall of the lower base 115. For example, a user may assemble the middle cover 345 and/or the inner lid 370 into the lower base 115 by 'snapping' the respective component into the corresponding engagement features in the wall of the lower base 115. As depicted, each of the middle cover 345 and the inner lid 370 are provided with a grip element 375. The grip element 375 may, for example, be configured as a tab. A user may, for example, advantageously grasp the grip element 375 to decouple the respective component from the lower base 115. For example, a user may wish to remove the middle cover 345 and/or the inner lid 370 to retrieve a weight in the bottom of the lower base 115. For example, the lower base 115 may be configured to stow a gift. In some embodiments the gift (e.g., jewelry, candy) may, for example, serve as a weight.

Figure 4A:
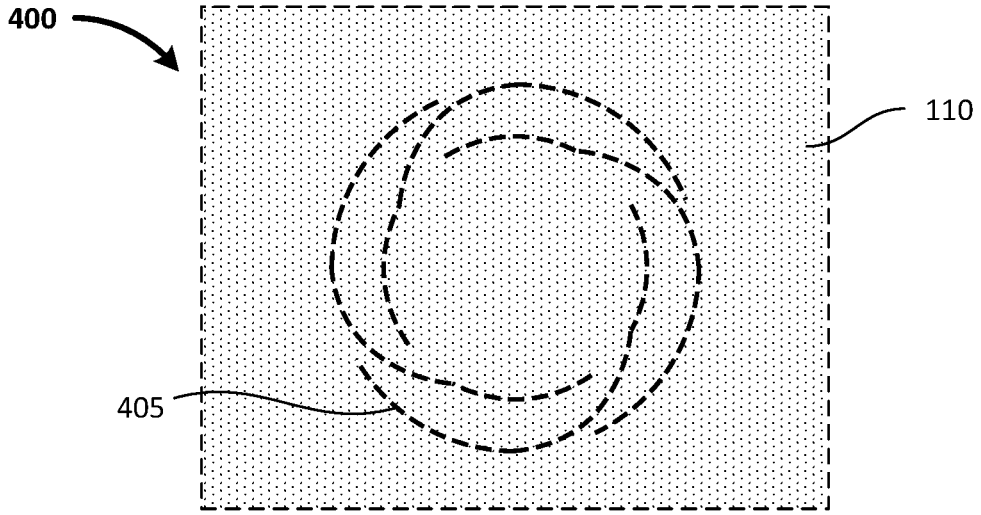
FIG. 4A, FIG. 4B, and FIG. 4C show an exemplary cupcake reception basket for holding a cupcake.
Figure 4B:
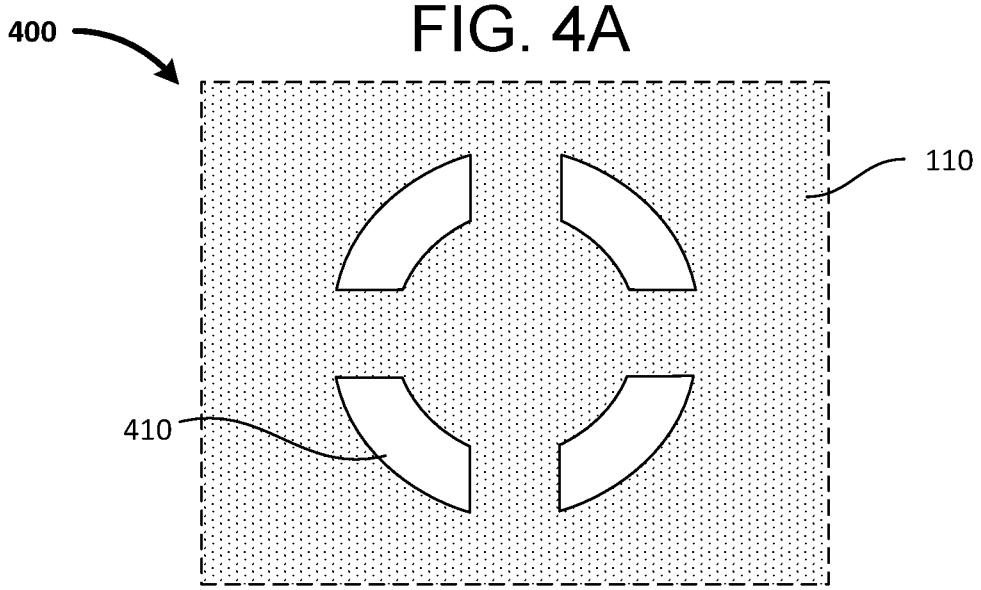
Figure 4C:
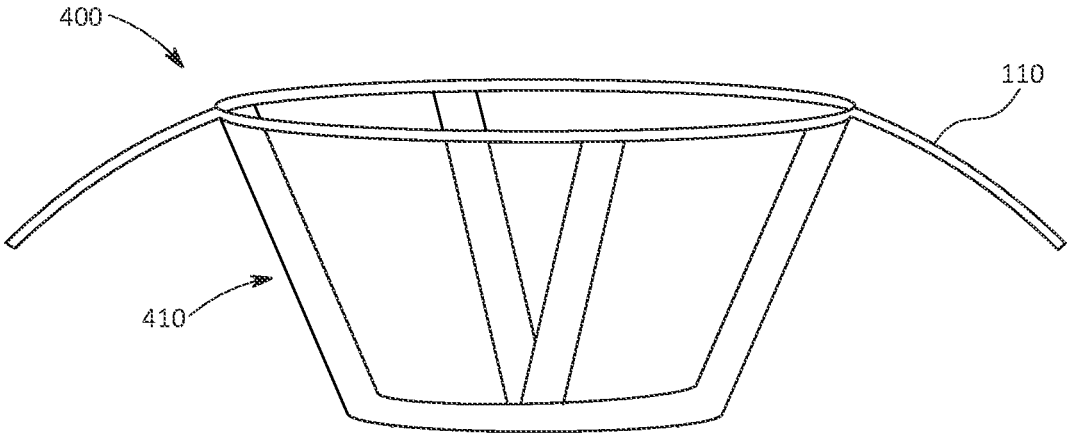

FIG. 4A, FIG. 4B, and FIG. 4C show an exemplary cupcake reception basket 400 for holding a cupcake. FIG. 4A shows a top-view of the exemplary cupcake reception basket 400 in a stowage mode. For example, the cupcake reception basket 400 may be positioned on the upper cover 110 of the cupcake bouquet frame 100 for holding the cupcake 105. As shown in FIG. 4A, the cupcake reception basket 400 includes cut-lines 405. In some implementations, the cut-lines 405 may be made by mass production. For example, during a manufacturing process, a plurality of the cut-lines 405 may be die-cut on the upper cover 110. In some implementations, the cut-lines 405 may be created by manually cutting the upper cover 110. For example, a user may create the cut-lines 405 by cutting the upper cover 110 following a cutting mold. In some examples, the cutting mold may be provided by the manufacturer of the cupcake bouquet frame 100 (e.g., as a kit with one or more of the upper cover 110).

The cupcake reception basket 400 is depicted in FIGS. 4A-4C in the context of a cupcake bouquet frame. In various embodiments, a reception basket may be applied to a cupcake bouquet support element. For example, an insert may be provided for an existing bouquet support structure. In various embodiments, a reception basket may be configured to receive non-cupcake confections (e.g., cookies). In some embodiments a reception basket may be provided in a confection transport and/or storage container (e.g., cardboard box, polymeric box). Various embodiments may advantageously allow further engagement of a received object (e.g., a deeper well to receive a cupcake deeper through an aperture) while determining a maximum engagement depth of the object (e.g., prevent a cupcake from falling through the aperture).

FIG. 4B shows a top-view of the cupcake reception basket 400 in a deployment mode. In this example, the material of the upper cover 110 may follow the cut-lines 405 and drop down to create a basket 410. In some examples, the cupcake reception basket 400 may hold the cupcake in place and prevent the cupcake from being placed too far into the opening. FIG. 4C shows a side view of the cupcake reception basket 400 in the deployed mode.

Figure 5:
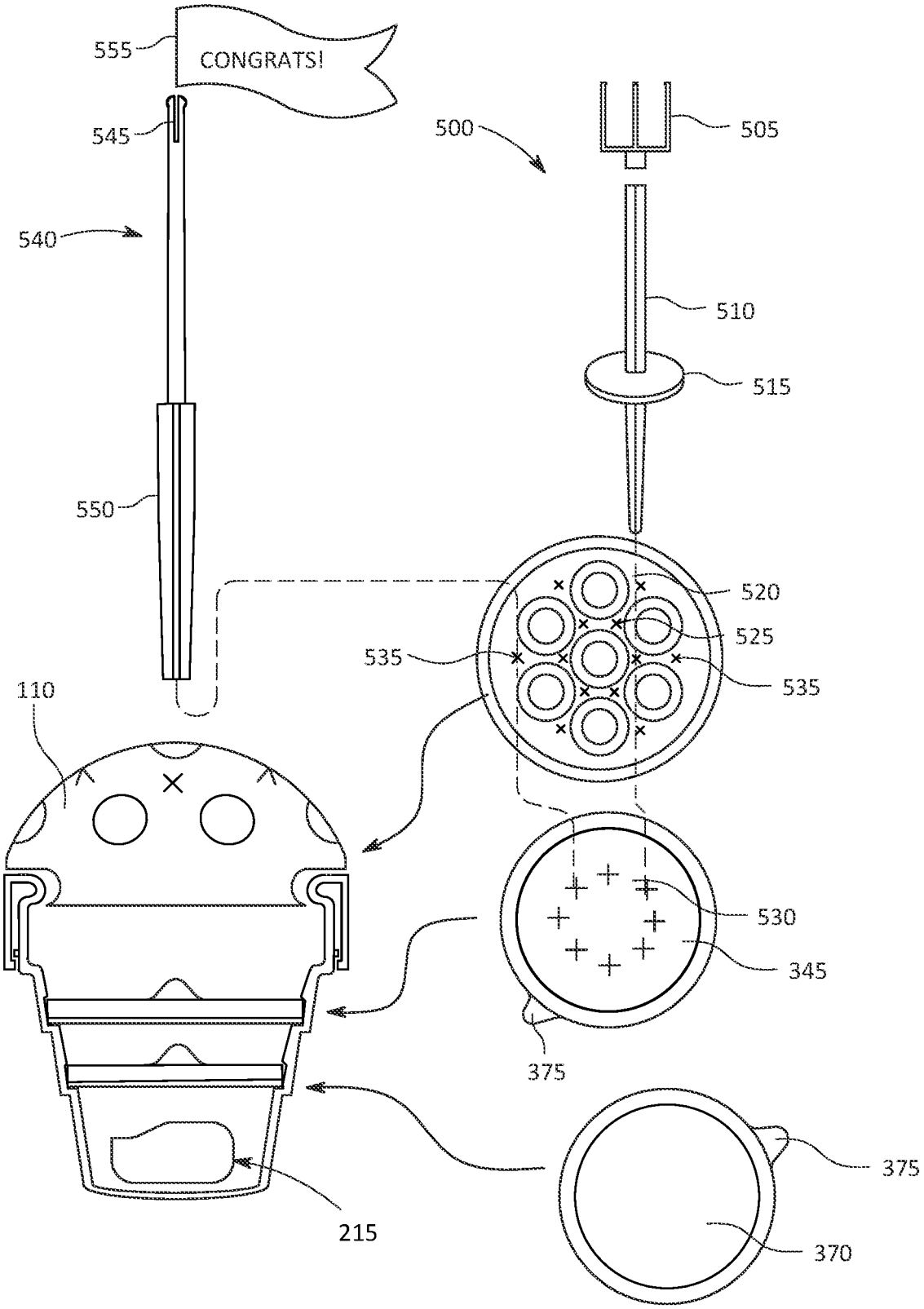
FIG. 5 shows an exploded assembly for installing an exemplary elevated cupcake holder.

FIG. 5 shows an exploded assembly for installing an exemplary cupcake holder stick 500. In this example, a cupcake holder stick 500 includes a prong 505, a stalk 510, and a height adjustment disc 515. In various embodiments, the prong 505, the stalk 510, and the height adjustment disc 515 may be manufactured as a single unit or separately. For example, a user may choose the prong 505, the stalk 510, and the height adjustment disc 515 of different parameters based on the user's design for quick assembly of the cupcake holder stick 500. As shown, the cupcake holder stick 500 is inserted into the cupcake bouquet frame 100 by following a line 520 through a slit 525 in the upper cover 110, and a slit 530 of the middle cover 345.

In some implementations, the stalk 510 may be tapered such that the top end of the stalk 510 is wider than the bottom end of the stalk 510. For example, the stalk 510 may fit tighter at the slit 525 than the slit 530 to maintain a resiliency as of the cupcake holder stick 500 is put down through the slits 525, 530.

The height adjustment disc 515 may, in some implementations, be used to adjust the position of the prongs 505 and the cupcake held in the prongs 505. For example, a user may insert the height adjustment disc 515 distally away from the prong. For example, the height adjustment disc 515 may rest on the upper cover 110 at a selective distance from the prongs 505. In some implementations, the distance may be predetermined by the manufacturer of the cupcake holder stick 500. In other implementations, the distance may be adjustable by a user of the cupcake holder stick 500 by sliding the height adjustment disc 515 along the stalk 510. For example, the user may adjust the distance between a bottom of the prongs 505 and the height adjustment disc 515 to be 2". As an example, the prongs 505 may hold a cupcake at 2" above the upper cover 110.

In various embodiments, the upper cover 110 may include cross-like openings 535 for a plurality of utilities. For example, the cross-like openings 535 may accept decorative elements such as additional greenery and/or square material to create the illusion of leaves. For example, the cross-like openings 535 may accept holder sticks of other confectionery items. For example, the cross-like openings 535 may be configured to receive a message holder. For example, the message holder may be registered with at least two of the cross-like openings to hold up a sign of a message, "Happy Birthday!"

In the depicted example, a message holder 540 is provided. The message holder 540 includes a stalk 550 with a coupling feature 545. As depicted, the coupling feature 545 is configured as a slit in the stalk 550. The coupling feature 545 is configured to receive a message, such as a depicted message banner 555. The stalk 550 may, for example, be assembled to the upper cover 110 and/or the lower base 115 (e.g., through the middle cover 345 and/or the inner lid 370), such as disclosed at least with reference to the cupcake holder stick 500.

Although various embodiments have been described with reference to the figures, other embodiments are possible. In some embodiments, the upper cover 110 and the lower base 115 may be a single unit. For example, the upper cover 110 and the lower base 115 may be connected on one side like a clamshell. In some examples, the clamshell assembly may reduce number of components for assembly and advantageously improve assembly speed.

In various embodiments, the cupcake bouquet frame 100 may advantageously fit multiple types of commercially available receptacles (e.g., the decorative base 130). Depending on an occasion, a user may selectively choose a decorative base for making a cupcake bouquet.

Although an exemplary system has been described with reference to the figures, other implementations may be deployed in other industrial, scientific, medical, commercial, and/or residential applications. In some examples, small confectionaries may use a similar structure to the cupcake bouquet frame to create a bouquet like gift. For example, by adjusting the size of the openings 120, the bouquet frame 100 may be used to hold chocolate cake, apple pie, and/or other small bakery pastries.

In some embodiments, frames such as disclosed at least with reference to FIGS. 1-5, may be configured for non-cupcake confections. For example, in some embodiments, frames may be configured for cookies. Frames may, for example, be configured for candies. Frames may, for example, be configured for muffins. Frames may, for example, be configured for scones. Such embodiments may, for example, be provided with apertures, baskets, and/or accessories configured to receive one or more target confections.

In some implementations, for example, packaging for one or more cupcakes may be provided, such as disclosed at least with reference to the Appendix of U.S. Provisional Application Ser. No. 63/262,227, titled "Configurable Bakery Bouquet Display," filed by Heather Karina Loyo, on Oct. 7, 2021, the entirety of which is incorporated herein by reference.

In some embodiments, by way of example and not limitation, one or more vases and/or other shapes may be provided to a bouquet holder and/or an outer container in which the holder is disposed. Various examples may, for example, be configured such as disclosed at least with reference to the Appendix of U.S. Provisional Application Ser. No. 63/262,227, titled "Configurable Bakery Bouquet Display," filed by Heather Karina Loyo, on Oct. 7, 2021, the entirety of which is incorporated herein by reference.

In some implementations, one or more arrangements of apertures and/or other confection holders may be configured as disclosed at least with reference to the Appendix of U.S. Provisional Application Ser. No. 63/262,227, titled "Configurable Bakery Bouquet Display," filed by Heather Karina Loyo, on Oct. 7, 2021, the entirety of which is incorporated herein by reference.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A confectionery bouquet holder, comprising:

an upper cover comprises a continuous surface in a permanent shape; and, a lower base comprising a predetermined coupling region configured to mechanically couple to the upper cover, and defining a cavity configured to receive a weight, wherein the predetermined coupling region defines an opening plane of the lower base such that the cavity extends out of the opening plane, such that, when the upper cover is releasably coupled into the lower base, the cavity is enclosed by the upper cover, wherein:

the continuous surface comprises a plurality of spatially distributed apertures, and each of the plurality of spatially distributed apertures is configured to support a confection, such that, when confection are disposed into and supported by at least some of the spatially distributed apertures, the confectionery bouquet holder gives a visual illusion of a flower bouquet.

2. The confectionery bouquet holder of claim 1, further comprising:

a decorative material disposed between and extending beyond the upper cover and the lower base such that, when the upper cover is releasably coupled into the lower base, the decorative material extending beyond the upper cover is urged upward.

3. The confectionery bouquet holder of claim 1, further comprising a flexible sheet of material disposed between each confection and the corresponding aperture, the sheet of material extending beyond the confection such that, when the confection is disposed in the aperture, the sheet of material conforms to a bottom surface of the confection and at least two boundary edges of the sheet of material extend beyond a region of contact between the aperture and the confection such that the at least two boundary edges provide handles for removing the confection from the aperture without directly touching the confection.

4. The confectionery bouquet holder of claim 1, wherein:

the upper cover is dome shaped, and, when a confection is disposed in any of the plurality of the spatially distributed apertures, an angle between a vertical axis of the confectionery bouquet holder and a vertical axis of the disposed confection is less than 80°.

5. The confectionery bouquet holder of claim 1, wherein the upper cover further comprises cutlines configured such that the plurality of spatially distributed apertures is formed by following the cutlines, such that, in a stowage mode, the plurality of spatially distributed apertures is substantially continuous with the continuous surface, and, in a display mode, when a confection is inserted into one of the spatially distributed apertures, a portion of the continuous surface is displaced to support a bottom of a disposed confection while remaining in physical connection to the continuous surface.

6. The confectionery bouquet holder of claim 1, wherein the lower base further comprises a bottom compartment covered by an inner lid, wherein the lower base is weighted down by a weight enclosed in the bottom compartment such that, the confectionery bouquet holder is prevented from being accidentally tipped over.

7. The confectionery bouquet holder of claim 6, wherein the bottom compartment comprises a divider device such that the enclosed weight is substantially evenly distributed across the lower base.

8. The confectionery bouquet holder of claim 1, wherein the lower base further comprises:

a ribbon tab configured to hold a ribbon between the ribbon tab and an outer surface of the lower base; and, a ribbon tab holder pointing towards the ribbon tab such that, when a ribbon is inserted between the ribbon tab and the outer surface of the lower base, the ribbon tab holder supports the ribbon.

9. The confectionery bouquet holder of claim 1, wherein:

the upper cover further comprises at least one upper stalk receiving element configured to receive a stalk; and, the lower base further comprises a middle cover in an interior cavity of the lower base, wherein the middle cover comprises at least one lower stalk receiving element configured to receive the stalk inserted through the upper stalk receiving element.

10. The confectionery bouquet holder of claim 9, wherein the upper stalk receiving element is configured to mate with a cross-sectional perimeter shape of the stalk such that, when engaged, the upper stalk receiving element resists rotation of the stalk.

11. The confectionery bouquet holder of claim 9, further comprising the stalk, wherein:

an upper portion of the stalk is coupled to the upper cover by a first retaining disk coupled to an upper end of the stalk, and, a lower portion of the stalk is coupled to a second retaining disk coupled to the middle cover.

12. The confectionery bouquet holder of claim 9, wherein a message holder is coupled to a top end of the stalk.

13. The confectionery bouquet holder of claim 9, further comprising the stalk, wherein the stalk comprises:

a prong coupled to a top end of the stalk configured to hold a confection; and, a height adjusting disk releasably coupled to the stalk distally away from the prong, such that a height of the confection is adjustable by adjusting a position of the height adjusting disk along the stalk.

14. A cupcake bouquet holder, comprising:

an upper cover defining a continuous surface having cutlines defining a plurality of spatially distributed confection holders such that, for each of the plurality of spatially distributed confection holders:

in a stowage mode, the confection holders are substantially continuous with the continuous surface, and, in a display mode, when a confection is inserted into the confection holder, a portion of the continuous surface is displaced along the cutlines out of continuity with the continuous surface of the upper cover to form a receptacle configured to support a bottom of the confection while remaining in physical connection to the continuous surface.

15. The cupcake bouquet holder of claim 14, wherein:

the upper cover is dome shaped, and, when a confection is disposed in any of the plurality of the spatially distributed confectionery holders, an angle between a vertical axis of the cupcake bouquet holder and a vertical axis of the disposed confection is less than 80°.

16. The cupcake bouquet holder of claim 14, further comprising:

a lower base comprising a predetermined coupling region configured such that the upper cover is releasably coupled into the lower base; and, a decorative material disposed between and extending beyond the upper cover and the lower base such that, when the upper cover is releasably coupled into the lower base, the decorative material extending beyond the upper cover is urged upward.

17. The cupcake bouquet holder of claim 16, wherein the lower base further comprises:

a bottom compartment covered by an inner lid; and, a divider device disposed within the bottom compartment, wherein:

the cupcake bouquet holder is weighted down by a weight enclosed in the bottom compartment and evenly distributed across the lower base such that the distribution is maintained by the divider device such that, the cupcake bouquet holder is prevented from being accidentally tipped over.

18. The cupcake bouquet holder of claim 16, wherein the lower base further comprises:

a ribbon tab extending substantially parallel to an outer surface of the lower base configured to hold a ribbon between the ribbon tab and the outer surface of the lower base; and, a ribbon tab holder pointing towards the ribbon tab such that, when a ribbon is inserted between the ribbon tab and the outer surface of the lower base, the ribbon tab holder supports the ribbon.

19. The cupcake bouquet holder of claim 16, wherein:

the upper cover further comprises at least one upper stalk receiving element configured to receive a stalk; and, the lower base further comprises a middle cover in an interior cavity of the lower base, wherein the middle cover comprises at least one lower stalk receiving element configured to receive the stalk inserted through the upper stalk receiving element.

20. The cupcake bouquet holder of claim 19, wherein the upper stalk receiving element is configured to mate with a cross-sectional perimeter shape of the stalk such that, when engaged, the upper stalk receiving element resists rotation.

21. The cupcake bouquet holder of claim 19, further comprising the stalk, wherein:

an upper portion of the stalk is coupled to the upper cover by a first retaining disk coupled to an upper end of the stalk, and, a lower portion of the stalk is coupled to a second retaining disk coupled to the middle cover.

22. The cupcake bouquet holder of claim 19, further comprising the stalk, wherein the stalk comprises:

a prong coupled to a top end of the stalk configured to hold a confectionery; and, a height adjusting disk releasably coupled to the stalk distally away from the prong, such that a height of the confectionery is adjustable by adjusting a position of the height adjusting disk along the stalk.

23. The confectionery bouquet holder of claim 14, wherein the continuous surface of the upper cover comprises a rigid dome.

* * * * *